US006648209B2

(12) United States Patent
Hohl et al.

(10) Patent No.: US 6,648,209 B2
(45) Date of Patent: Nov. 18, 2003

(54) PROCESS FOR PRODUCING WELDED STEEL PIPES WITH A HIGH DEGREE OF STRENGTH, DUCTILITY AND DEFORMABILITY

(75) Inventors: Gerold Hohl, Neuss (DE); Gerhard Knauf, Duisburg (DE)

(73) Assignee: Mannesmannröhren-Werke AG, Mülheim (DE)

( * ) Notice: Subject to any disclaimer, the term of this patent is extended or adjusted under 35 U.S.C. 154(b) by 3 days.

(21) Appl. No.: 10/033,379

(22) Filed: Nov. 13, 2001

(65) Prior Publication Data

US 2002/0117538 A1 Aug. 29, 2002

Related U.S. Application Data

(63) Continuation of application No. PCT/DE00/01513, filed on May 10, 2000.

(30) Foreign Application Priority Data

May 10, 1999 (DE) ..... 199 22 542
May 9, 2000 (DE) ..... 100 23 488

(51) Int. Cl.[7] ..... B23K 39/02; B23K 31/02; H05B 6/10

(52) U.S. Cl. ..... 228/173.6; 228/227; 219/643

(58) Field of Search ..... 228/17.5, 164, 228/173.1, 173.6, 227; 219/635, 643

(56) References Cited

U.S. PATENT DOCUMENTS 4,001,054 A * 1/1977 Makepeace ..... 148/220
4,160,543 A * 7/1979 Dill et al. ..... 266/252
4,945,743 A * 8/1990 Yasumura et al. ..... 72/128
4,975,128 A * 12/1990 Schmitz ..... 148/520
5,005,395 A * 4/1991 Yasumura et al. ..... 72/128
6,331,216 B1 * 12/2001 Toyooka et al. ..... 148/320
2002/0117239 A1 * 8/2002 Oku et al.
2002/0117538 A1 * 8/2002 Hohl et al.
2002/0136661 A1 * 9/2002 Yazawa et al.

FOREIGN PATENT DOCUMENTS

| | | | | |
|---|---|---|---|---|
| DE | 948 604 | C | | 9/1956 |
| DE | 43 18 931 | C | | 12/1994 |
| DE | 196 08 387 | A | | 7/1996 |
| DE | 195 22 790 | A1 | | 12/1996 |
| DE | 196 10 675 | C1 | | 2/1997 |
| EP | 0 494 448 | A | | 7/1992 |
| JP | 57035625 | | | 2/1982 |
| JP | 58009926 | | | 1/1983 |
| JP | 406184637 | A | * | 7/1994 |
| JP | 06212257 | A | * | 8/1994 |
| LU | 86 158 | A | | 6/1987 |
| WO | WO 96 00305 | A | | 1/1996 |

* cited by examiner

*Primary Examiner*—Tom Dunn
*Assistant Examiner*—Riley Stoner
(74) *Attorney, Agent, or Firm*—Henry M. Feiereisen

(57) ABSTRACT

In a process for producing welded steel pipes, a pipe is molded cold from a TM-rolled sheet, welded together and sized to the desired diameter, whereby the sheet includes steel with (in wt. %) 0.02 to 0.20% carbon, 0.05 to 0.50% silicon, 0.50 to 2.50% manganese, 0.003 to 0.06% aluminum, the remainder being iron with potentially other production-related impurities. After welding and sizing, the pipe is subjected to a heat treatment process at a temperature of 100–300° C. and for a holding time that is suited to the thickness of the pipe wall, with subsequent cooling with air or by forced cooling. The resulting pipe is resistant to aging and has sufficiently integral deformation reserve against fracturing with the same high degree of strength, without exceeding the upper limit for the ratio of yield strength to tensile stress according to the current industry standards for conventional steels.

30 Claims, No Drawings

PROCESS FOR PRODUCING WELDED STEEL PIPES WITH A HIGH DEGREE OF STRENGTH, DUCTILITY AND DEFORMABILITY

CROSS-REFERENCES TO RELATED APPLICATIONS

This application is a continuation of prior filed copending PCT International application no. PCT/DE00/01513, filed May 10, 2000.

This application claims the priority of German Patent Applications, Serial No. 199 22 542.7, filed May 10, 1999, and Serial No. 100 23 488.7, filed May 9, 2000, the subject matter of which is incorporated herein by reference.

BACKGROUND OF THE INVENTION

The present invention relates to a process for producing welded steel pipes with a high degree of strength, ductility and deformability, in particular line pipes, using the UOE-process. More particularly, the invention relates to a heat post-treatment of the popes after the welding and sizing operation.

The yield strength of sheet metal employed in the manufacture of pipes by cold molding, for example by the UOE-process, has to exceed at least a minimum specified value, so as to reliably and safely prevent flow of the finished pipe.

Pipes made of high-strength steel with a yield strength $R_{t0,5} \geqq 550$ MPa (X80 according to API-5L) can meet these requirements in practice only by having a comparatively high initial upper yield strength ratio due to the viscosity and deformation characteristics that have to be met at the same time. Current industry standards require a maximum upper yield strength ratio of, for example, 0.93 according to API5L, which due to work hardening during molding and sizing of the pipes is difficult to achieve in series production, requires complex manufacturing technology and increases production cost. Moreover, the cold-forming process reduces the integral deformation reserve due to the required high initial yield strength ratio for higher grade steel. Hence, it is difficult to realize in practice the integral deformation reserve $\epsilon_{up} \geqq 2\%$ required of the component when taking into account the typically observed statistical variations on pipes made of steel with a yield strength $R_{t0,5} \geqq 550$ MPa (X80). An integral deformation reserve of $\square_{up} \geqq 2\%$ has so far never been realized on pipes made of steel with a yield strength $R_{t0,5} \geqq 620$ MPa (X90). "Integral deformation reserve $\epsilon_{up}$" refers to the average peripheral plastic expansion of the pipe before wall necking, analogous to the elongation before reduction of area in a laboratory tensile tests. (Hohl, G. A. and Vogt, G. H.: Allowable strains for high strength line pipe, 3R international, 31 Yr., Vol. 12/92, p. 696–700).

To remedy this problem, it has been proposed in the past to change the composition of the alloy and/or the rolling technique to achieve the required higher deformation characteristic values. However, the options are limited in practice: on one hand, adding additional alloy materials, such as nickel, make the product significantly more expensive, while adding other alloy materials, such as boron, creates forming problems. On the other hand, the available temperature window, the cooling speed and the strain in the thermal-mechanical rolling process can only be changed within certain limits imposed by the employed technology.

A process referred to as "bake hardening" for increasing the strength of components is known from DE 196 10 675 C1. This process refers to an artificial aging process associated with enamel baking. The component is preferably coated in a zinc bath through which the previously cold-rolled tape passes. The zinc bath temperatures are in a range between 450–470° C. To enable reliable surface processing of conventional DP (dual-phase) steels, German Pat. No. DE 196 10 675 C1 discloses a steel with the following composition in wt. %:

0.05 to 0.3% carbon
0.8 to 3.0% manganese
0.4 to 2.5% aluminum
to 0.2% silicon.

The remainder is iron with steel-making related impurities. Cold rolling is followed by a heat treatment, preferably in a hot-dip galvanizing apparatus or in a continuous annealing furnace.

The micro-structure is comprised of a ferritic matrix in which martensite is incorporated in form of islands. The minimum characteristic values attainable by the conventional process are as follows:

| | |
|---|---|
| Yield strength ($R_{p0.2}$) | ≧200 MPa |
| Tensile stress ($R_m$) | ≧550 MPa |
| Ductile yield ($A_{80}$) | ≧25% |
| Ratio of yield strength to tensile stress ($R_{p0.2}/R_m$) | ≦0.7. |

The essential elements favored in the process disclosed in German Pat. No. DE 196 10 675 C1 are aluminum and silicon. The element silicon is maintained at a low concentration in order to suppress the formation of red scale during hot-rolling. Red scale poses the danger of drawing in scale that causes surface inhomogeneities when the tape is pickled. A high aluminum fraction promotes formation of ferrite during annealing between the conversion temperatures $A_{c1}$, and $A_{c3}$. Addition of aluminum also improves the adhesion characteristic of zinc as well as of the zinc-iron alloy layers. The formation of pearlite is moved to significantly longer times and can therefore be suppressed with the achievable cooling rates.

The conventional process cannot be applied to welded pipes made of high-strength steel, for instance grade X80 steel with a minimum yield strength of 550 MPa, since heat treatment in the temperature range of 450–470° C. is uneconomical due to the long heating and holding times. High-strength steels such as grade X65 steel, have a ratio of yield strength to tensile stress of >0.70, other steels have a ratio in the range between the 0.80–0.93.

It would therefore be desirable to develop a process for manufacturing welded steel pipes with a high degree of strength, ductility and deformability, in particular line pipes, using the UOE-process, wherein the process can be used to produce economically and reliably steel with grades ≧X80 with a minimum yield ratio of 550 MPa as well as acid gas-resistant grades, while maintaining the upper limit of the ratio of yield strength to tensile stress set by current industry standards.

SUMMARY OF THE INVENTION

The invention is directed to a process for producing welded steel pipes with a high degree of strength, ductility and deformability. In particular, the invention incorporates a heat post-treatment after the welding and sizing operation.

According to one aspect of the invention, a steel sheet with a composition (in wt. %) of 0.02 to 0.20% carbon; 0.05 to 0.50% silicon; 0.50 to 2.50% manganese; and 0.003 to 0.06% aluminum, the remainder representing iron with steel-making related impurities, is cold-formed into a pipe shape, welded and sized. The so obtained pipe undergoes heat post-treatment in a temperature range of 100–300° C. wherein the holding time is adapted to the pipe wall thickness. The pipe is subsequently cooled in air or by forced cooling. The holding time depends primarily on the wall thickness of the heated component and to a lesser extent on the type of heat supply. The pipe produced in this manner has the same high mechanical strength as conventionally produced pipes, but has more than twice the deformation reserves, without exceeding the upper limit for the ratio of yield strength to tensile stress set by current industry standards.

Advantageous embodiments may include one or several of the following features. The heat treatment can be performed in a continuous annealing furnace or by passage through an induction coil and/or induction furnace. In addition, the heat treatment can be performed in conjunction with the application of an outside insulation layer which can be a mono-layer or a multi-layer structure. The holding time can vary in extreme cases between seconds and several hours.

The pipes can be welded with a helical seam or a straight seam. Pipes having a straight seam can be presized before the heat treatment by a combined application of cold-expansion and cold-reduction, wherein the order and the degree of expansion and reduction is determined by the requested pipe profile.

Optimal results are achieved when the minimum initial yield strength of the sheet metal matches the minimum yield strength of the pipe after subtracting the increase of the yield strength due to cold-forming and heat treatment effects. A pipe fabricated in this way is resistant to aging and has particularly homogeneous properties along the periphery of the pipe.

According to another embodiment of the invention, additional elements can optionally be added to the alloys up to the previously described upper limits. For example, up to 0.02% phosphorus; up to 0.06% titanium; up to 0.20% chromium; up to 0.50% molybdenum; up to 0.30% nickel; up to 0.10% niobium; up to 0.08% vanadium; up to 0.50% copper; up to 0.030% nitrogen; and up to 0.005% boron can be added. Addition of these fractions may, for example, enhance certain mechanical properties for a specified wall thickness of the product.

Other features and advantages of the present invention will be more readily apparent upon reading the following description of preferred exemplified embodiments of the invention.

DETAILED DESCRIPTION OF PREFERRED EMBODIMENTS

A pipe with 56" outside diameter and 19.1 mm wall from X100 steel can be manufactured using a conventional process. In this case, the steel sheet requires a 2.0% yield strength of $R_{p2.0}$>710 MPa and a tensile strength of $R_m \geqq 770$ MPa. Since the final strength properties are determined by the initial values of the steel sheet and by work-hardening during forming and sizing of the pipes to the nominal diameter, the finished pipe may have a ratio of yield strength to tensile stress which limits the ability of the component to change its form when subjected to an inside pressure. As a result, when using conventional processes, the typical requirement for integral elongation of $\epsilon_{up} \geqq 2\%$ for high-strength pipes was hardly ever achieved or without a sufficient safety margin.

With the process according to the invention, a pipe is cold-formed, welded and sized to a desired diameter starting with a TM-rolled sheet having the composition 0.02 to 0.20% carbon, 0.05 to 0.50% silicon, 0.50 to 2.50% manganese, and 0.003 to 0.06% aluminum, with the remainder being iron containing production-related impurities. The pipe is subjected to heat treatment at a temperature in the range of 100–300° C. with a holding time that is adapted to the thickness of the pipe wall and can range from seconds to several hours. The pipe is subsequently cooled with air or by forced cooling.

With the aforedescribed process of the invention, a pipe of the same quality/grade and dimension as with conventional processes, while the steel sheet need only have a 2.0% yield strength of $R_{p2.0} \geqq 640$ MPa instead of ≧710 MPa, and a tensile strength of $R_m \geqq 770$ MPa. In particular, the yield strength can vary around the above value depending on the analysis of the employed steel grade and the degree of strain during the transformation from a steel sheet to a pipe. For example, the exemplary steel grade yields the following analysis (in wt. %):

C 0.096; Si 0.383; Mn 1.95; Al 0.035; P 0.015; Ti 0.019; Cr 0.062;

Mo 0.011; Ni 0.045; Nb 0.042; V 0.005; Cu 0.045; N 0.005; B 0.001.

It has been observed experimentally that the heat treatment according to the invention improves the mechanical parameters of the material, in particular the yield strength, so that the required minimum values can be reliably achieved with this process. The term "reliably achieved with this process" is intended to indicate that the increase represents a reserve which makes it possible to tolerate common variations with respect to alloy composition, wall thickness, rolling parameters, etc. As a result, the required minimum value could still be attained even if a combination of several unfavorable parameter were present simultaneously. This obviates the need for special measures that would otherwise be required with conventional processes.

Advantageously, pipes conditioned by such heat treatment resist aging at operating temperatures below the heat treatment temperature, for example 200° C. Accordingly, the mechanical characteristic of a pipeline made from those pipes is not expected to experience further changes during the operating life of the pipeline. The same applies to pipes made from steel grades >X80, where such heat treatment enables a control of their peripheral properties even in series production, which makes the process more reliable and reduces statistical variations.

Since the mechanical strength properties required in the peripheral direction are achieved concurrently with the heat post-treatment of the pipe, the steel sheet can have lower initial yield strength values and a lower ratio of yield strength to tensile stress while still attaining the specified pipe quality or grade. This makes it also possible to increase the elongation before reduction of the area to values of $A_g \geqq 8.5\%$ on the steel sheet and to values of $A_g \geqq 6.5\%$ on the pipe. In this way, twice the deformability of conventionally produced pipes can be achieved, so that the requirements for reliably providing an integral component reserve $\epsilon_{up} \geqq 2\%$ can be safely satisfied within the framework of the production-related variations even for pipe grades of X 100.

Heat treatment with an induction furnace can preferably be integrated in a facility where insulation is applied to the outside of the pipe. In this embodiment, the pipe or another component passes through the induction coil or induction furnace to heat the pipe for the purpose of applying a mono-layer or multi-layer insulation. This induction heating step can be used to simultaneously increase the parameters indicative of the mechanical strength to suitable levels, because the temperature required for applying the insulation is also in the proposed range of 100–300° C.

Advantageously, the strength and deformation characteristics measured in an acceptance test after application of the insulation are therefore controlling for the entire useful life for of a pipeline. Sheet metal and tapes with a lower initial yield strength can hence advantageously be employed, since they require a smaller forming force for forming an open seam pipe. This advantage is particularly important for thick-wall pipes.

The proposed heat treatment also helps to reproducibly maintain a small ratio of yield strength to tensile stress and provides a more uniform strength characteristic advantageous for series production. Unlike conventionally produced pipes, the component has hence higher deformation reserves against ductile fracture.

The effect obtained by providing a more uniform strength characteristic can be enhanced by additionally conditioning the pipes that have been produced with the UOE-process with the process proposed in German Pat. No. DE 195 22 790 A1. The characteristic properties of pipes can be tailored for specific applications, for example depending if the pipes are subjected to inside or outside pressure. The compositional range of the steel sheet in conjunction with the heat post-treatment according to the present invention yields the most favorable results concerning variations of the values along the periphery of the pipe and from one pipe to another, as well as concerning a potential reserve for dimensional changes available to a component.

The process of the invention can be applied to pipes having a straight welded seam as well as a helically welded seam (also referred to as serpentine pipes) produced by the HFI and UOE process.

The increase in yield strength in the peripheral direction of the pipe as a result of the heat post-treatment depends on the steel composition, the C and N fraction in forced solution and the parameters of the pipe manufacturing process. As presently understood, this increase can reach 18% of the $R_{t0.5}$ yield strength measured on the expanded pipe in circular tensile tests. For unexpanded pipes, such as HFI pipes, increases of up to 12% are achieved according to recent observations. The tensile strength $R_m$ increases as a result of the heat post-treatment by approximately 20 MPa.

In addition, an analysis of the steel shows that the concentration of the major constituents covers the range for high-strength line pipe steels.

While the invention has been illustrated and described as embodied in a process for producing welded steel pipes with a high degree of strength, ductility and deformability, it is not intended to be limited to the details shown since various modifications and structural changes may be made without departing in any way from the spirit of the present invention.

What is claimed is:

1. A process for producing welded steel pipes by the UOE-process, comprising the steps of:

providing a steel sheet having a composition by wt. % of 0.02 to 0.20% carbon, 0.05 to 0.50% silicon, 0.50 to 2.50% manganese, and 0.003 to 0.06% aluminum, up to 0.02% phosphorus, up to 0.06% titanium, up to 0.20% chromium, up to 0.50% molybdenum, up to 0.30% nickel, up to 0.10% niobium, up to 0.08% vanadium, up to 0.50% copper, up to 0.030% nitrogen, and up to 0.005% boron, the remainder being iron containing production-related impurities;

cold-forming, welding and sizing the sheet to a desired diameter to thereby form a pipe;

subjecting the pipe to a heat treatment at a temperature in the range of 100–300° C., while holding the pipe at that temperature for a time suited to a wall thickness of the pipe; and cooling the pipe with at least one of air cooling and forced cooling to thereby realize a finished steel pipe.

2. The process of claim 1, wherein the steel sheet TM-rolled sheet.

3. The process of claim 1, wherein the pipe is a line pipe.

4. The process of claim 1, wherein an increase of the yield strength due to cold-forming and the heat treatment is substantially equal to the difference between a minimum yield strength Of the pipe and a minimum initial yield strength of the steel sheet.

5. The process of claim 1, wherein the heat treatment is implemented in a continuous annealing furnace.

6. The process of claim 1, wherein the heat treatment step includes passing the pipe through an induction coil.

7. The process of claim 1, wherein the heat treatment step includes passing the pipe through an induction furnace.

8. A process for producing welded steel pipes by the UGE-process, comprising the steps of:

providing a steel sheet having a composition by wt. % of 0.02 to 0.20% carbon, 0.05 to 0.50% silicon, 0.50 to 2.50% manganese, and 0.003 to 0.06% aluminum, the remainder being iron containing production-related impurities;

cold-forming, welding and sizing the sheet to a desired diameter to thereby form a pipe;

subjecting the pipe to a heat treatment at a temperature in the range of 100–300° C., while holding the pipe at that temperature for a time suited to a wall thickness of the pipe;

cooling the pipe with at least one of air cooling and forced cooling; and applying an insulation layer to an outside surface of the pipe, wherein the heat treatment is executed while the applying step is implemented.

9. The process of claim 8, wherein the insulation layer is a mono-layer insulation layer or multi-layer insulation layer.

10. A process for producing welded steel pipes by the UOE-process, comprising the steps of:

providing a steel sheet having a composition by wt. % of 0.02 to 0.20% carbon, 0.05 to 0.50% silicon, 0.50 to 2.50% manganese, and 0.003 to 0.06% aluminum, the remainder being iron containing production-related impurities;

cold-forming, welding and sizing the sheet to a desired diameter to thereby form a pipe;

subjecting the pipe to a heat treatment at a temperature in the range of 100–300° C. while holding the pipe at that temperature for a time suited to a wall thickness of the pipe;

cooling the pipe with at least one of air cooling and forced cooling;

wherein the pipes are welded with a straight seam and presized before the heat treatment by a combined application of cold-expansion and cold-reduction.

11. The process of claim 10, and further including defining a pipe profile and arranging the order and a degree of cold-expansion and cold-reduction according to the defined pipe profile.

12. A process for producing welded steel pipes by the UOE-process, comprising the steps of:

providing a steel sheet having a composition by wt. % of 0.02 to 0.20% carbon, 0.05 to 0.50% silicon, 0.50 to 2.50% manganese, and 0.003 to 0.06% aluminum, the remainder being iron containing production-related impurities;

cold-forming, welding and sizing the sheet to a desired diameter to thereby form a pipe;

subjecting the pipe to a heat treatment at a temperature in the range of 100–300° C., while holding the pipe at that temperature for a time suited to a wall thickness of the ripe;

cooling the pipe with at least one of air cooling and forced cooling to thereby realize a finished steel pipe;

wherein the steel sheet has a 2.0% yield strength of $R_{p2.0} \geqq 640$ MPa and a tensile strength of $R_m \geqq 770$ MPa.

13. The process of claim 8, wherein the steel sheet is a TM-rolled sheet.

14. The process of claim 8, wherein the pipe is a line pipe.

15. The process of claim 8, wherein an increase of the yield strength due to cold-forming and the heat treatment is substantially equal to the difference between a minimum yield strength of the pipe and a minimum initial yield strength of the steel sheet.

16. The process of claim 8, wherein the heat treatment step is implemented in a continuous annealing furnace.

17. The process of claim 8, wherein the heat treatment step includes passing the pipe through an induction coil.

18. The process of claim 8, wherein the heat treatment step includes passing the pipe through an induction furnace.

19. The process of claim 10, wherein the steel sheet is a TM-rolled sheet.

20. The process of claim 10, wherein the pipe is a line pipe.

21. The process of claim 10, wherein an increase of the yield strength due to cold-forming and the heat treatment is substantially equal to the difference between a minimum yield strength of the pipe and a minimum initial yield strength of the steel sheet.

22. The process of claim 10, wherein the heat treatment step is implemented in a continuous annealing furnace.

23. The process of claim 10, wherein the heat treatment step includes passing the pipe through an induction coil.

24. The process of claim 10, wherein the heat treatment step includes passing the pipe through an induction furnace.

25. The process of claim 12, wherein the steel sheet is a TM-rolled sheet.

26. The process of claim 12, wherein the pipe is a line pipe.

27. The process of claim 12, wherein an increase of the yield strength due to cold-forming and the heat treatment is substantially equal to the difference between a minimum yield strength of the pipe and a minimum initial yield strength of the steel sheet.

28. The process of claim 12, wherein the heat treatment step is implemented in a continuous annealing furnace.

29. The process of claim 12, wherein the heat treatment step includes passing the pipe through an induction coil.

30. The process of claim 12, wherein the heat treatment step includes passing the pipe through an induction furnace.

* * * * *